US005691531A

United States Patent [19]

Harris et al.

[11] Patent Number: 5,691,531

[45] Date of Patent: Nov. 25, 1997

[54] DATA INSERTION SYSTEM FOR MODULATING THE CARRIER OF A RADIO VOICE TRANSMITTER WITH MISSILE CONTROL SIGNALS

[75] Inventors: Gordon L. Harris, Rancho Santa Fe; Neil A. Levy, Encinitas; Daniel R. Weisz, Vista, all of Calif.

[73] Assignee: Leigh Aerosystems Corporation, Carlsbad, Calif.

[21] Appl. No.: 744,284

[22] Filed: Nov. 6, 1996

Related U.S. Application Data

[60] Provisional application No. 60/006,293, Nov. 9, 1995.

[51] Int. Cl.[6] ..... F41G 9/00; H04Q 7/00

[52] U.S. Cl. ..... 244/3.14; 244/3.11; 89/1.11; 89/1.56; 455/33.1

[58] Field of Search ..... 244/3.14, 3.11, 244/3.1; 89/1.11, 1.56, 1.51; 455/33.1; 364/922.5, 223.1

[56] References Cited

U.S. PATENT DOCUMENTS

| | | | |
|---|---|---|---|
| H1641 | 4/1997 | Sharman | 455/33.1 |
| 2,885,667 | 5/1959 | Downey et al. | 244/3.14 |
| 3,746,288 | 7/1973 | Schoneborn | 244/3.14 |
| 4,096,380 | 6/1978 | Eichweber | 244/3.14 |
| 4,146,196 | 3/1979 | Schultz | 244/3.1 |
| 4,471,683 | 9/1984 | Brown | 89/1.11 |
| 5,118,050 | 6/1992 | Arnold et al. | 244/3.14 |
| 5,131,602 | 7/1992 | Linick | 244/3.14 |
| 5,243,530 | 9/1993 | Stanifer et al. | 364/452 |
| 5,348,250 | 9/1994 | Semier et al. | 244/3.16 |
| 5,362,334 | 11/1994 | Adams et al. | 148/268 |
| 5,372,334 | 12/1994 | Cuadros | 244/3.11 |
| 5,448,237 | 9/1995 | Borgen et al. | 341/131 |
| 5,479,480 | 12/1995 | Scott | 455/33.1 |
| 5,487,175 | 1/1996 | Bayley et al. | 455/33.1 |
| 5,497,339 | 3/1996 | Bernard | 364/705.05 |

OTHER PUBLICATIONS

1992 ARRL Handbook for Radio Amateurs, pp. 19–25, 19–43, and 19–44.

*Primary Examiner*—Michael J. Carone
*Assistant Examiner*—Theresa M. Wesson
*Attorney, Agent, or Firm*—Edward A. Sokolski

[57] ABSTRACT

A microcomputer with a modem is programmed with information for controlling a flight control computer on a missile. The microcomputer is carried on an aircraft from which the missile is controlled. The pilot of the aircraft has a keypad for setting the target coordinates in the microcomputer. The audio signals from the microcomputer modem are fed to the voice communications system of the aircraft so as to modulate the carrier of the transmitted signal. This signal is received by the receiver on the missile and demodulated and employed to control signals for the missile in the missile flight control computer. The pilot of the aircraft sets in target coordinates for the missile on a keypad connected to the microcomputer.

6 Claims, 1 Drawing Sheet

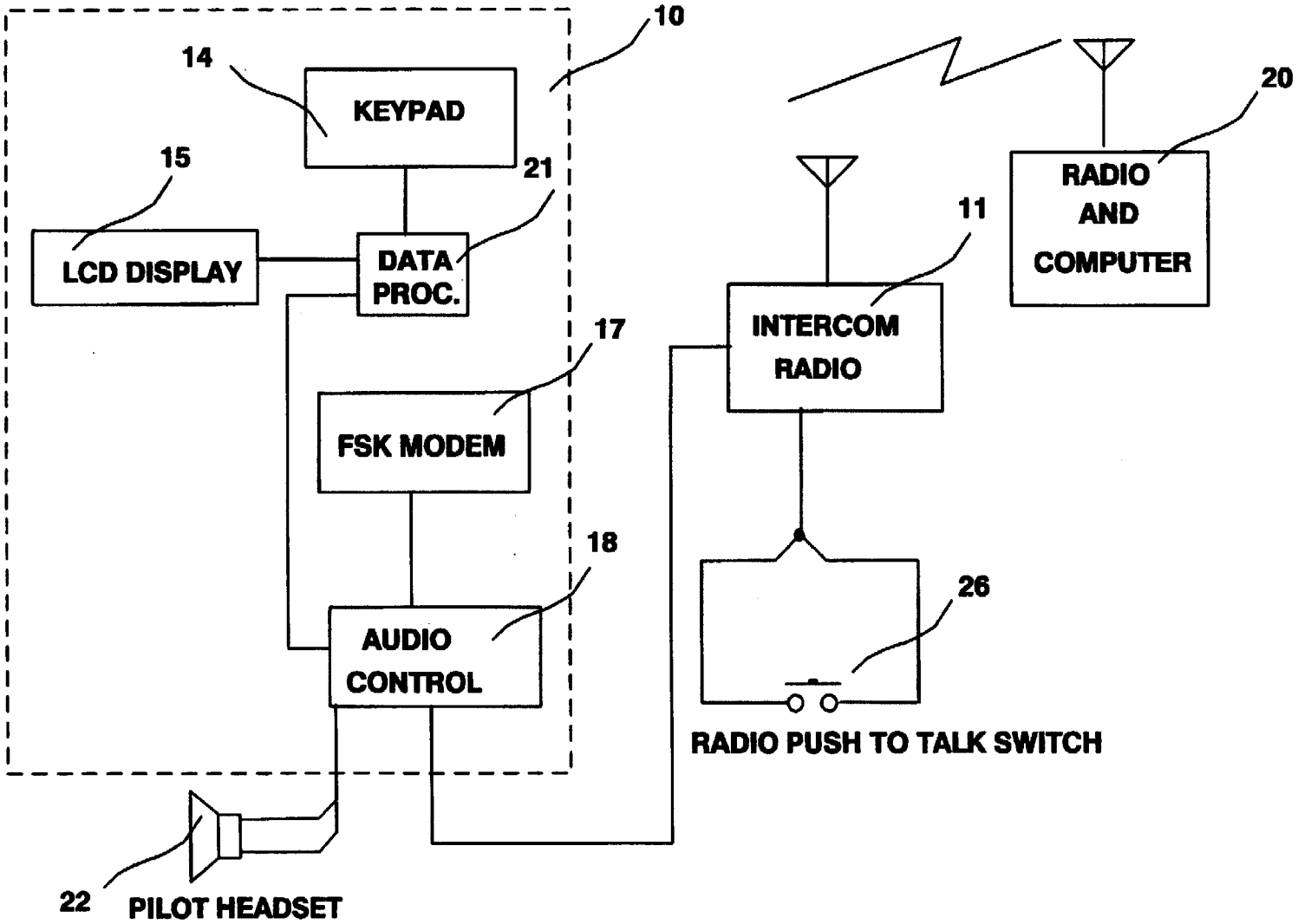
FIGURE

DATA INSERTION SYSTEM FOR MODULATING THE CARRIER OF A RADIO VOICE TRANSMITTER WITH MISSILE CONTROL SIGNALS

BACKGROUND OF THE INVENTION

This application claims the benefit of U.S. Provisional Application No. 60/006,293, filed Nov. 9, 1995.

1. Field of the Invention

This invention relates to missile control systems and more particularly to a communications system for transmitting control signals for such a system.

2. Description of the Related Art

Systems for transmitting control signals for controlling the flight of a missile once it is launched are generally sent on a separate radio or laser carrier which is used solely for this purpose. Such systems are described in U.S. Pat. No. 4,146,196 issued Mar. 27, 1979 to Schultz and U.S. Pat. No. 5,372,334 issued Dec. 13, 1994 to Cuadros. The use of a separate communications link for the missile control operation necessitates the use of an additional transmitter and receiver. Radio amateurs recognizing the need to use the radio spectrum as efficiently as possible have employed their normal radio communications carriers in packet radio wherein the same carrier is simultaneously used for multiple communications. To applicants' knowledge, however, no one has derived a system for utilizing the radio communications transmitter of an aircraft for transmitting control signals for controlling the flight of a missile.

BRIEF SUMMARY OF THE INVENTION

The present invention provides a system in which the regular radio communications transmitter of an aircraft or other control site is used to transmit the control signals for controlling the flight of a missile launched from the aircraft or some other site. This end result is achieved by employing a data insertion unit on the aircraft which includes a hand-held microcomputer having a data processor and a modem for converting the computer signals to audio for transmission on the radio communications carrier of the aircraft. The data processor is preprogrammed for control of the missile and control signals as to the target coordinates are entered into the data processor by means of a keypad operated by the pilot. The audio output of the modem is used to modulate the carrier of the radio transmitter and is received and utilized by a computer on the missile to control the flight of the missile. A display screen and tone are provided to prompt the pilot when the microcomputer is ready to transmit so that the pilot can then switch to a separate frequency used for the missile control and activate his radio "push-to talk" button to enable transmission to the missile flight control computer. When the transmission of the microcomputer has been completed, a second signal and display is received prompting the pilot to release the transmit button. As long as the communications radio is tuned to the missile control frequency, the pilot can monitor transmissions from the missile computer.

It is therefore an object of this invention to enable the use of the regular communications transmitter of an aircraft for transmitting signals for controlling a missile.

Other objects of the invention will become apparent in connection with the following description in conjunction with the accompanying drawings.

BRIEF DESCRIPTION OF THE DRAWINGS

The sole FIGURE is a functional block diagram of a preferred embodiment of the invention.

DETAILED DESCRIPTION OF THE INVENTION

Referring to the sole FIGURE, a preferred embodiment of the invention is shown.

Data Insertion Unit(DIU) 10 is preferably a hand-held battery powered micro-computer with a built in modem and audio relay subsystem. A commercially available unit such as the model no. 4010 manufactured by Octagon Systems, Westminster, Colo. may be employed. This unit may be strapped to the leg of the pilot to facilitate its handling.

The audio output of the DIU is fed from audio control 18 to the intercom/radio 11 of the aircraft (or other control site). This audio output is fed to audio control 18. Voice signals of the pilot are fed from headset 22 to audio control 18. The audio control 18 of the DIU is placed between the pilot's headset/mic cable and the intercom system using the same type of connector ordinarily used without the DIU.

The DIU utilizes an internal modem which may be 1200 baud to convert the digital information generated by data processor 21 representing target information and commands for the missile into an audio signal which is transmitted by radio 11 to radio and computer 20 on the missile. The computer 20 has a modem similar to modem 17, and signals can be sent back to DIU 10 from the transmitter of the radio and computer 20. The pilot can use keypad 14 to enter data representing target coordinates into the processor 21. LCD display 15 indicates to the pilot when to activate the radio transmitter to transmit signals to radio and computer 20.

The system is operated as follows: Using menu options, the pilot selects the weapon station desired and downloads the targeting information into data processor 21 with keypad 14. The data processor 21 then provides a control signal to audio control 18 which connects the audio output of modem 17 to intercom/radio 11 and disconnects the headset 22 therefrom. At the appropriate time the DIU notifies the pilot that it is ready to communicate by providing a prompting signal on display 15 and a tone signal to the pilot's headset. Upon receiving this notification, the pilot actuates push to talk switch 26 so that the audio output of the DIU is transmitted by the radio transmitter of intercom/radio 11 to radio and computer 20. At the end of this transmission the DIU will notify the pilot by a different tone and display which will prompt the pilot to release push to talk switch 26. It is to be noted that prior to pushing the push to talk switch, the radio of radio/intercom 11 must be tuned to the frequency of the radio of radio and computer 20. A signal is sent from radio and computer 20 notifying that the transmission was received by transmitting similar date back. When the transmission is completed, the data processor controls audio control 18 to reconnect the pilot headset to the intercom/radio and disconnect the modem therefrom.

The pilot can stay tuned to the frequency of the radio and computer 20 if it is desired to monitor transmissions from the radio.

It is to be noted that while the system of the invention has been described in connection with an aircraft site, it may also be used at other sites such as ground stations, ground vehicles or ships.

While the invention has been described and illustrated in detail, it is to be clearly understood that this is intended by way of illustration and example only and is not to be taken by way of limitation, the scope of the invention being limited only by the terms of the following claims.

We claim:

1. A system for utilizing a regular intercom/radio voice communication device for transmitting control signals from a control site to a missile radio receiver and computer control comprising:

a data insertion unit at the site, said data insertion unit including a data processor, a modem for converting the output signals of said data processor to audio signals, an audio control, and a keypad, the data processor being preprogrammed for control of the missile, the keypad being manually operable to provide control signals in accordance with the coordinates of a target, a headset including a microphone connected to said audio control, the audio signal output of said modem being fed to said audio control, and means for controlling said audio control to alternatively feed either the output of said headset microphone or the output of said modem to said intercom/radio communication device.

2. The system of claim 1 wherein said means for controlling said audio control comprises the data processor.

3. The system of claim 1 wherein said control site is an aircraft.

4. The system of claim 1 and further including a visual display for indicating when the output of said modem is being fed to the intercom/radio voice communications system.

5. A method for alternatively utilizing a radio communication system either for voice communications or for the transmission of audio control signals generated by a computer for controlling a missile comprising:

connecting the audio output of said computer to an audio control switching device, connecting a microphone to said audio control switching device, connecting the output of said audio control switching device to the radio communications system, and controlling said audio control switching device to alternatively either connect the output of said computer or the output of said microphone to the radio communications system for transmission thereby.

6. The method of claim 5 wherein the audio control switching device is controlled by a microprocessor in said computer.

* * * * *

UNITED STATES PATENT AND TRADEMARK OFFICE

CERTIFICATE OF CORRECTION

PATENT NO. : 5,691,531
APPLICATION NO. : 08/744284
DATED : November 25, 1997
INVENTOR(S) : Gordon Harris et al.

It is certified that error appears in the above-identified patent and that said Letters Patent is hereby corrected as shown below:

The title page should be deleted to appear as per attached title page.

The sheet of drawing consisting of the illustrated figure should be deleted to appear as per attached sheet.

Signed and Sealed this

Twenty-first Day of August, 2007

JON W. DUDAS
*Director of the United States Patent and Trademark Office*

United States Patent [19]

Harris et al.

[11] Patent Number: 5,691,531

[45] Date of Patent: Nov. 25, 1997

[54] DATA INSERTION SYSTEM FOR MODULATING THE CARRIER OF A RADIO VOICE TRANSMITTER WITH MISSILE CONTROL SIGNALS

[75] Inventors: Gordon L. Harris, Rancho Santa Fe; Neil A. Levy, Encinitas; Daniel R. Weisz, Vista, all of Calif.

[73] Assignee: Leigh Aerosystems Corporation, Carlsbad, Calif.

[21] Appl. No.: 744,284

[22] Filed: Nov. 6, 1996

Related U.S. Application Data

[60] Provisional application No. 60/006,293, Nov. 9, 1995.

[51] Int. Cl.[6] ..... F41G 9/00; H04Q 7/00

[52] U.S. Cl. ..... 244/3.14; 244/3.11; 89/1.11; 89/1.56; 455/33.1

[58] Field of Search ..... 244/3.14, 3.11, 244/3.1; 89/1.11, 1.56, 1.51; 455/33.1; 364/922.5, 223.1

[56] References Cited

U.S. PATENT DOCUMENTS

| | | | |
|---|---|---|---|
| H1641 | 4/1997 | Sharman | 455/33.1 |
| 2,885,667 | 5/1959 | Dawney et al. | 244/3.14 |
| 3,746,288 | 7/1973 | Schoneborn | 244/3.14 |
| 4,096,380 | 6/1978 | Eichweber | 244/3.14 |
| 4,146,196 | 3/1979 | Schultz | 244/3.1 |
| 4,471,683 | 9/1984 | Brown | 89/1.11 |
| 5,118,059 | 6/1992 | Arnold et al. | 244/3.14 |
| 5,131,602 | 7/1992 | Linick | 244/3.14 |
| 5,243,530 | 9/1993 | Stanifer et al. | 364/452 |
| 5,348,250 | 9/1994 | Semler et al. | 244/3.16 |
| 5,362,334 | 11/1994 | Adams et al. | 148/268 |
| 5,372,334 | 12/1994 | Cuadros | 244/3.11 |
| 5,448,237 | 9/1995 | Borgen et al. | 341/131 |
| 5,479,480 | 12/1995 | Scott | 455/33.1 |
| 5,487,175 | 1/1996 | Bayley et al. | 455/33.1 |
| 5,497,339 | 3/1996 | Bernard | 364/705.05 |

OTHER PUBLICATIONS

1992 ARRL Handbook for Radio Amateurs, pp. 19–25, 19–43, and 19–44.

*Primary Examiner*—Michael J. Carone
*Assistant Examiner*—Theresa M. Wesson
*Attorney, Agent, or Firm*—Edward A. Sokolski

[57] ABSTRACT

A microcomputer with a modem is programmed with information for controlling a flight control computer on a missile. The microcomputer is carried on an aircraft from which the missile is controlled. The pilot of the aircraft has a keypad for setting the target coordinates in the microcomputer. The audio signals from the microcomputer modem are fed to the voice communications system of the aircraft so as to modulate the carrier of the transmitted signal. This signal is received by the receiver on the missile and demodulated and employed to control signals for the missile in the missile flight control computer. The pilot of the aircraft sets in target coordinates for the missile on a keypad connected to the microcomputer.

6 Claims, 1 Drawing Sheet

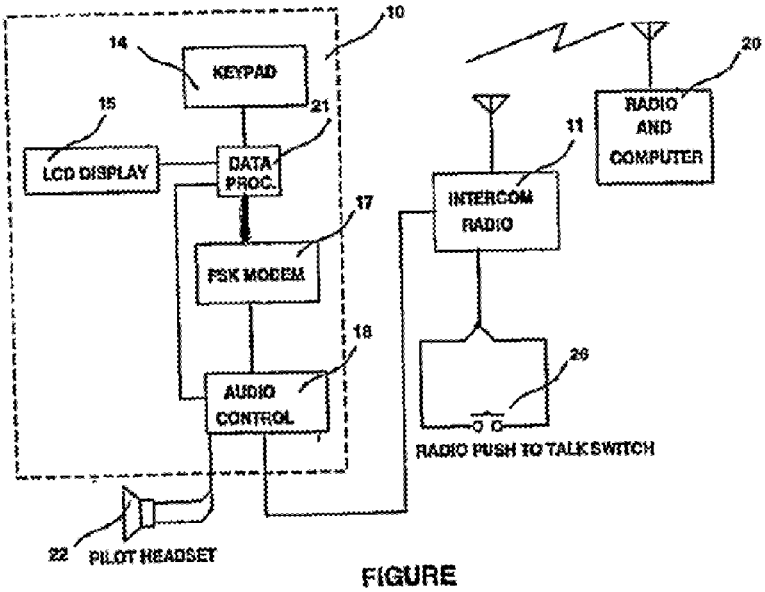

FIGURE

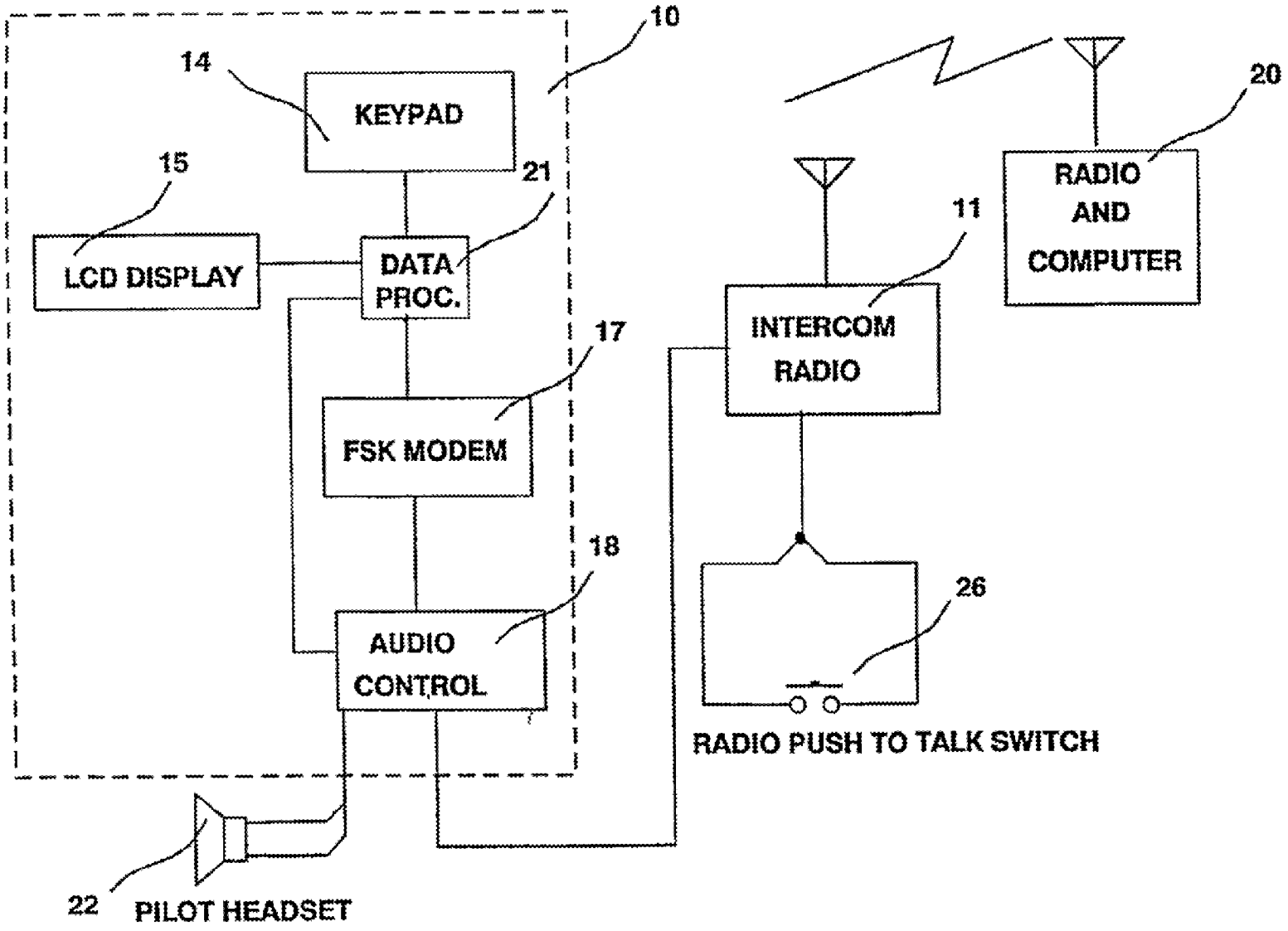
FIGURE